US005218772A

United States Patent [19]

Dickson, Sr.

[11] Patent Number: 5,218,772

[45] Date of Patent: Jun. 15, 1993

[54] HAIR DRYER HOOD CONDUIT

[76] Inventor: Leon Dickson, Sr., 3785 Kerwin Dr., Memphis, Tenn. 38128

[21] Appl. No.: 905,880

[22] Filed: Jun. 29, 1992

[51] Int. Cl.[5] ..... A45D 20/00

[52] U.S. Cl. ..... 34/99; 34/96

[58] Field of Search ..... 34/96, 97, 98, 99, 100, 34/101, 90, 91, 3; 392/380

[56] References Cited

U.S. PATENT DOCUMENTS

| | | | |
|---|---|---|---|
| 2,290,455 | 7/1942 | Stephen | 34/99 |
| 2,295,820 | 9/1942 | Wright | 34/99 |
| 2,453,364 | 11/1948 | Fears | 34/99 |
| 2,471,657 | 5/1949 | Saye | 34/99 |
| 2,474,165 | 6/1949 | Roberts | 34/99 |
| 2,576,226 | 11/1951 | Huber et al. | 34/99 |
| 2,632,960 | 3/1953 | Bucknell et al. | 34/99 |
| 2,665,501 | 1/1954 | Jones | 34/99 |
| 2,820,305 | 1/1958 | Brown | 34/99 |
| 3,032,891 | 5/1962 | Parker | 34/99 |
| 3,043,016 | 7/1962 | Miller | 34/99 |
| 3,044,183 | 7/1962 | Mauch et al. | 34/99 |
| 3,818,600 | 6/1974 | Fischer | 34/99 |
| 5,029,404 | 7/1991 | Terrell | 34/99 |

*Primary Examiner*—Henry A. Bennett
*Assistant Examiner*—Denise Gromada
*Attorney, Agent, or Firm*—Leon Gilden

[57] ABSTRACT

A hair dryer hood conduit is arranged for mounting to a lower annular end of a hair dryer hood, with the hood conduit having a cylindrical body formed with a lower elastomeric band arranged for securement about an individual's head to direct heat thereto. A modification of the invention includes window members arranged through the body to modulate heat directed onto an individual's head.

2 Claims, 4 Drawing Sheets

HAIR DRYER HOOD CONDUIT

BACKGROUND OF THE INVENTION

1. Field of the Invention

This field of invention relates to hair drying apparatus, and more particularly pertains to a new and improved hair dryer hood conduit wherein the same is arranged to effect an efficient hood onto an individual's head minimizing heat loss.

2. Description of the Prior Art

Conventional hair drying within a hair dryer hood is effective, but a considerable volume of air flow is lost and associated thermal drying of the individual's hair therewith by spacing of a hood relative to an individual's head. The instant invention attempts to overcome deficiencies of the prior art by providing for a hair dryer hood structure having a conduit arranged for mounting thereto to effect speeding of a hair drying procedure, as well as minimizing loss of energy during such procedure. Prior art hair dryers utilizing dispersing hoods and the like are exemplified in the U.S. Pat. No. 4,662,084 to Maass.

U.S. Pat. No. 3,600,821 to Simon sets forth a hair dryer hood assembly of flexible configuration.

U.S. Pat. No. 4,934,068 to Curlee sets forth a hair dryer heat deflector device mounted about a lower periphery of a hair dryer hood.

U.S. Pat. No. 3,818,600 to Fischer sets forth a hair dryer and hood structure of conventional construction within the prior art.

As such, it may be appreciated there continues to be a need for a new and improved hair dryer hood conduit as set forth by the instant invention which addresses both the problems of ease of use as well as effectiveness in construction in the directing of hair drying heat onto an individual's head and in this respect, the present invention substantially fulfills this need.

SUMMARY OF THE INVENTION

In view of the foregoing disadvantages inherent in the known types of hair dryer apparatus now present in the prior art, the present invention provides a hair dryer hood conduit wherein the same is arranged for simultaneous mounting to a lower peripheral edge of a hair dryer hood and to an individual's head to direct heat thereto. As such, the general purpose of the present invention, which will be described subsequently in greater detail, is to provide a new and improved hair dryer hood conduit which has all the advantages of the prior art hair dryer apparatus and none of the disadvantages.

To attain this, the present invention provides a hair dryer hood conduit arranged for mounting to a lower annular end of a hair dryer hood, with the hood conduit having a cylindrical body formed with a lower elastomeric band arranged for securement about an individual's head to direct heat thereto. A modification of the invention includes window members arranged through the body to modulate heat directed onto an individual's head.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair dryer hood conduit which has all the advantages of the prior art hair dryer apparatus and none of the disadvantages.

It is another object of the present invention to provide a new and improved hair dryer hood conduit which may be easily and efficiently manufactured and marketed.

It is a further object of the present invention to provide a new and improved hair dryer hood conduit which is of a durable and reliable construction.

An even further object of the present invention is to provide a new and improved hair dryer hood conduit which is susceptible of a low cost of manufacture with regard to both materials and labor, and which accordingly is then susceptible of low prices of sale to the consuming public, thereby making such hair dryer hood conduits economically available to the buying public.

Still yet another object of the present invention is to provide a new and improved hair dryer hood conduit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
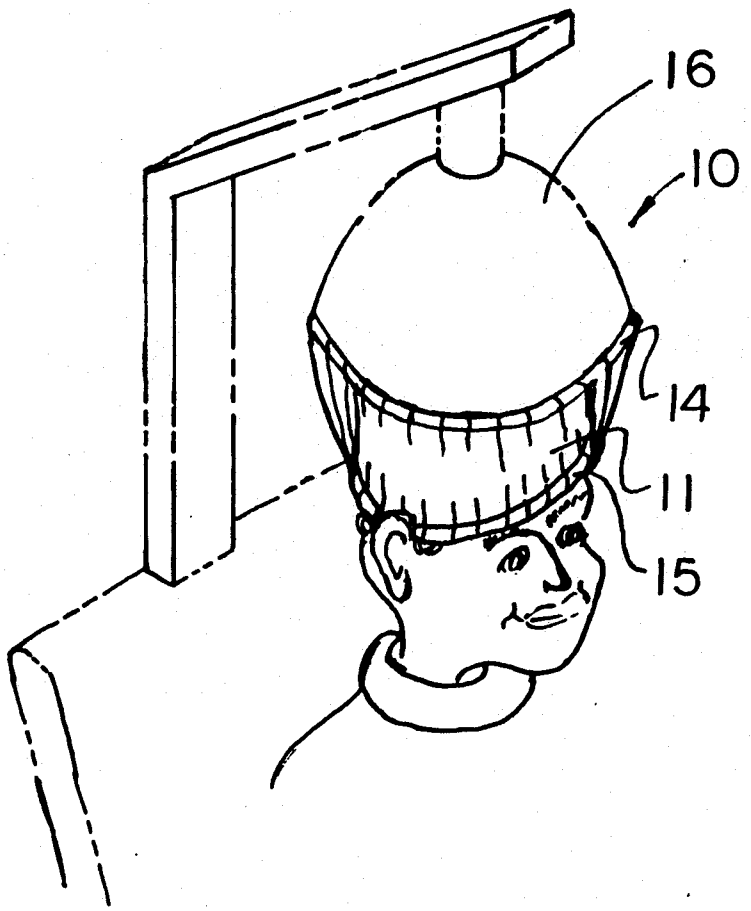
FIG. 2 is an isometric illustration of the invention in use.
Figure 1:
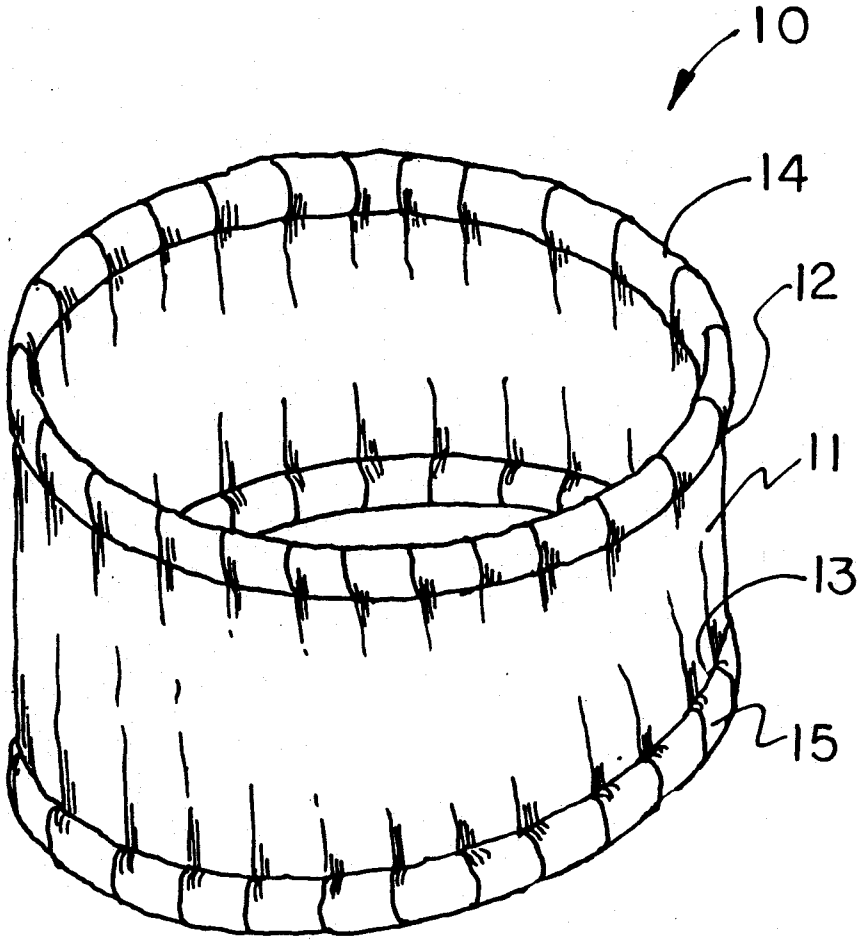
FIG. 1 is an isometric illustration of the instant invention.
Figure 3:
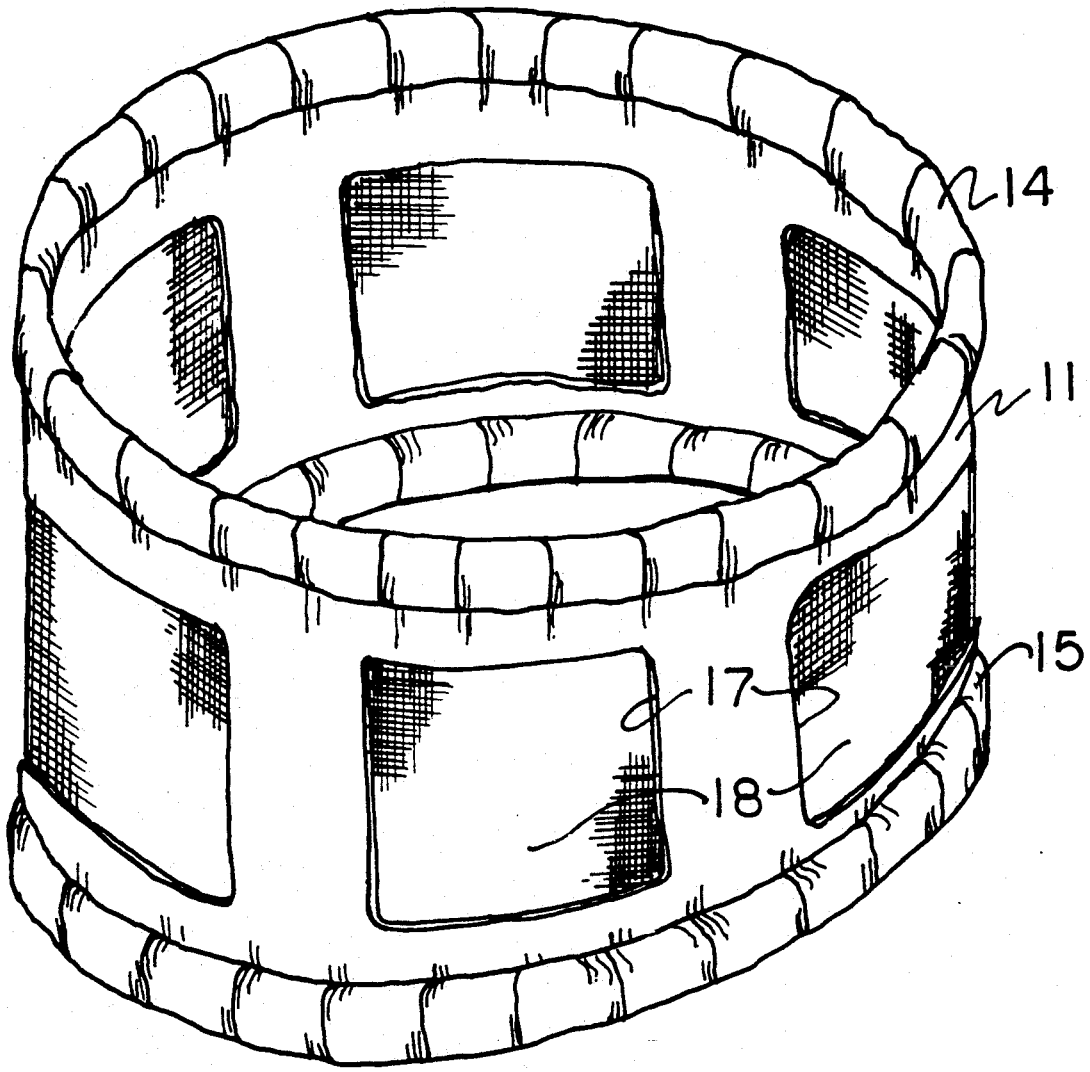
FIG. 3 is an isometric modified aspect of the body structure of the invention.

With reference now to the drawings, and in particular to FIGS. 1 to 5 thereof, a new and improved hair dryer hood conduit embodying the principles and concepts of the present invention and generally designated by the reference numeral 10 will be described.

More specifically, the hair dryer hood conduit 10 of the instant invention essentially comprises a cylindrical body 11 formed of a flexible fabric web having an annular first end 12 spaced from an annular second end 13. If required, the annular first end and the annular second end respectively define annular openings and may be canted relative to one another. A first elastomeric band 14 and a second elastomeric band 15 are mounted coextensively about the respective first and second ends respectively for securement to a lower distal end of a hair dryer hood assembly 16 by the first elastomeric band 14 and to an individual's head portion by the second elastomeric band 15, as illustrated in FIG. 2, to direct heat thusly ducted onto an individual's hair region to effect enhanced drying therethrough. The cylindrical body may be formed of a porous web to permit directing of air flow therethrough, or further, the body may be formed of a plurality of body openings 17, as illustrated in the FIG. 3, with each body opening including a screen member 18 coextensive therewith to effect metered air flow through each opening in this manner. Thusly, heated air having absorbed moisture from the hair drying procedure may be ducted exteriorly of the cylindrical body 11.

Figure 4:
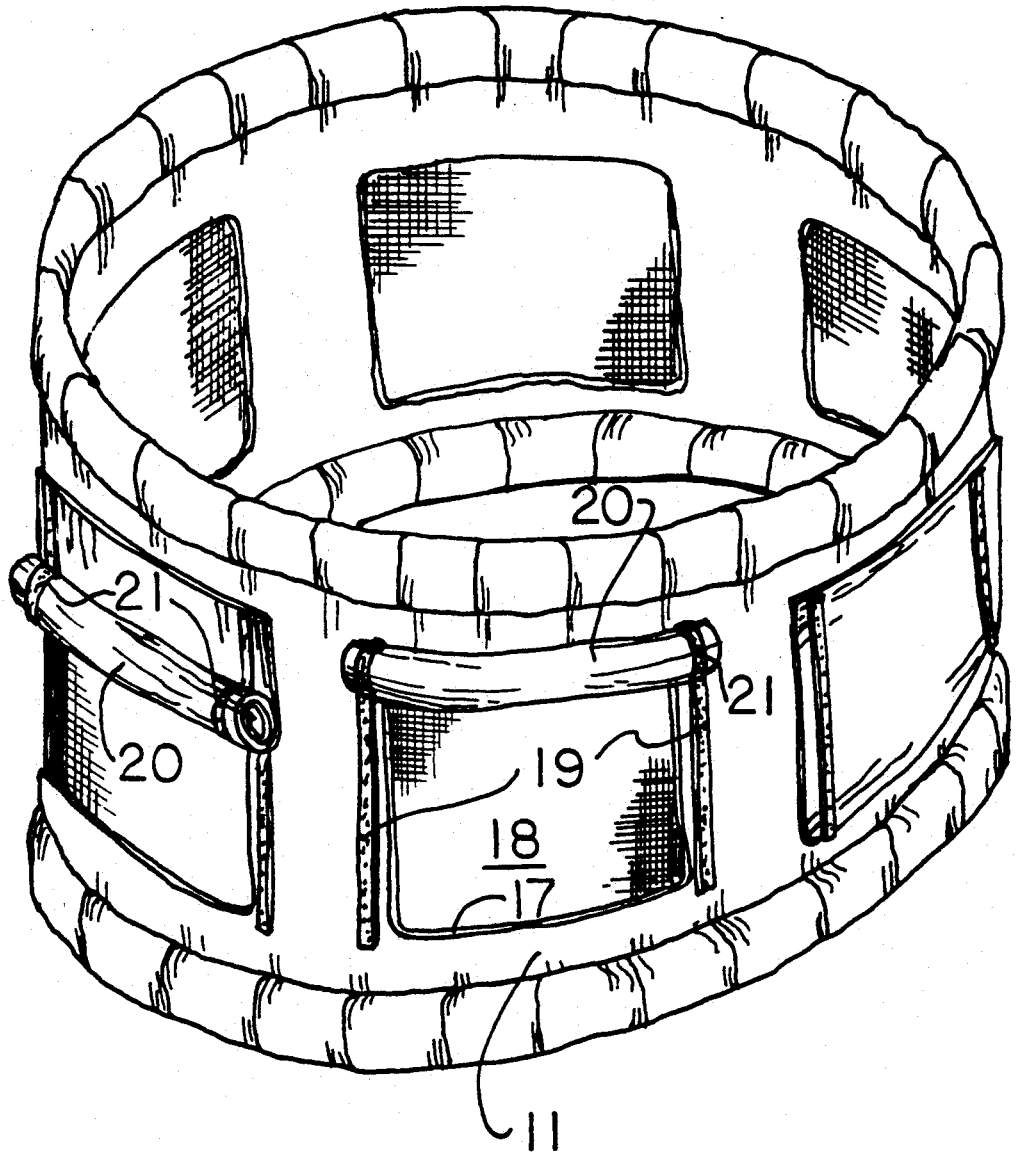
FIG. 4 is an isometric illustration of the body structure having window members mounted to the openings formed therethrough.
Figure 5:
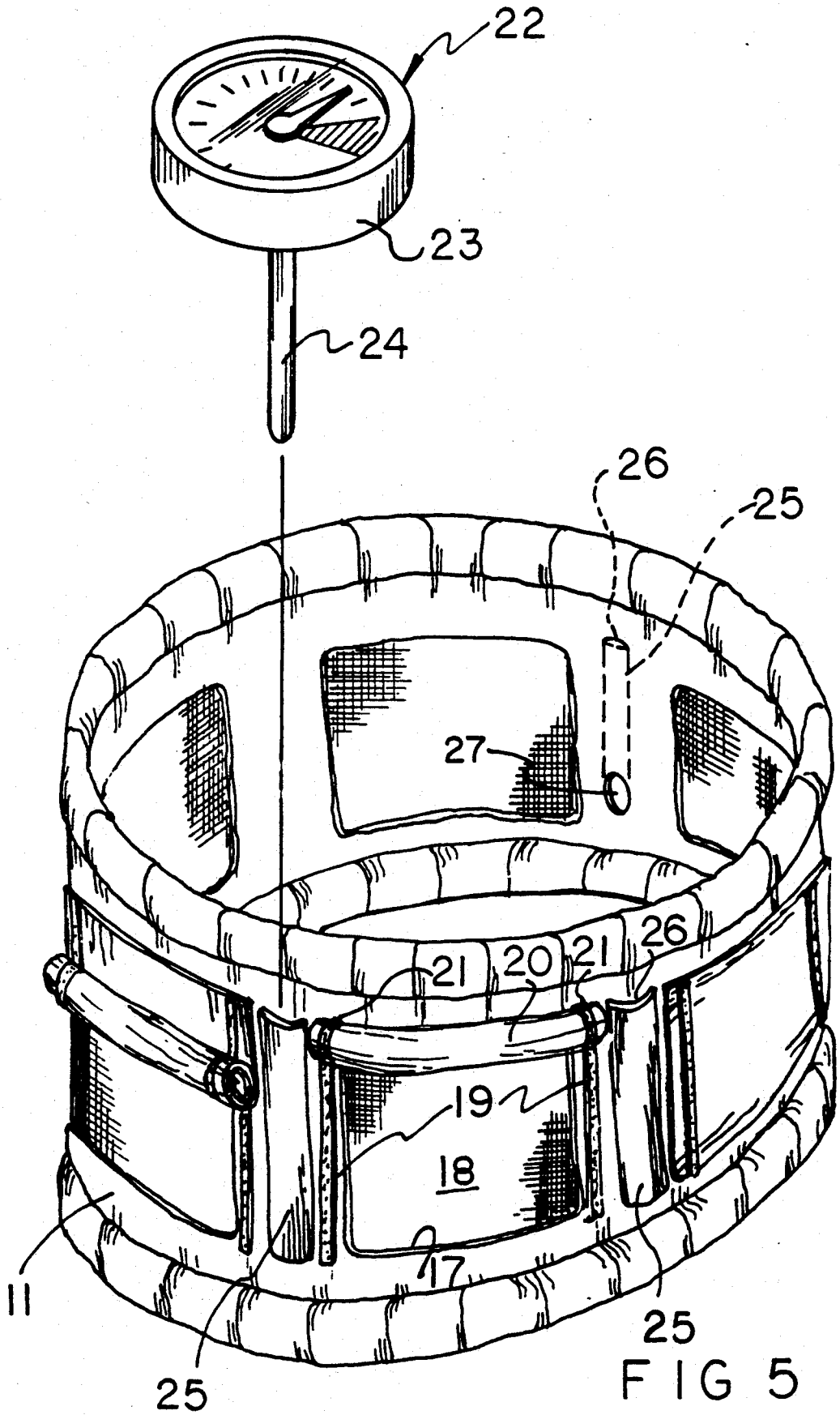
FIG. 5 is an isometric illustration of a yet further modified aspect of the invention.

The FIGS. 4 and 5 illustrate each body opening 17 formed with body opening parallel side hook and loop fastener strips 19 extending coextensively along each opposed side of each opening to accommodate a flexible cover web 20 having cover web parallel side hook and loop fastener strips 21 cooperative with the bag opening side hook and loop fastener strips 19. The fastener strips 19 may be spaced apart a predetermined spacing equal to a predetermined spacing spaced apart by the fastener strips 21. In this manner, the opening strips 17 may be adjusted to accommodate various air flow therethrough to accommodate various hair dryers and their respective volumetric flow.

FIG. 5 further sets forth the use of a thermometer 22 having a thermometer head 23 and a thermometer transmitter rod 24 extending therebelow. The body 11 includes a body pocket 25 positioned between adjacent openings 17. The body pocket includes an upper entrance opening 26 at an upper distal end of the pocket positioned exteriorly of the body 11 to receive the transmitter rod 24. A lower opening 27 at a lower distal end of the pocket 25 is directed through the body 11 into communication interiorly of the body 11. Accordingly, the body pocket 25 is of a predetermined height substantially equal to the predetermined length of the transmitter rod 24. In this manner, temperature within the body 11 may be determined and to thereby permit adjusting of opening 17 by the various cover webs 20 to maintain a predetermined temperature within the body 11 during use for comfort and convenience of individual's utilizing the invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair dryer hood conduit arranged for securement to a lower distal end of a hair dryer hood, comprising, a cylindrical body formed of a flexible fabric web, the cylindrical body having an annular first end spaced from an annular second end, the first end defines a first opening, the second end defines a second opening, and the annular first end includes a first elastomeric band arranged in contiguous securement to the first end, and a second elastomeric band secured in contiguous securement to the second end, and the cylindrical body includes a plurality of body openings directed through the cylindrical body, with each body opening directed through the cylindrical body, with each body opening including a mesh screen member mounted coextensively therewithin, and each body opening includes parallel sides, and each of the parallel sides includes a first hook and loop fastener strip, wherein each first hook and loop fastener strip of each body opening is spaced apart from an adjacent first hook and loop fastener strip of said body opening a predetermined spacing, and a flexible cover web mounted to an upper distal end of each body opening, wherein the flexible cover web includes second hook and loop fastener strips arranged in a parallel relationship on opposed sides of each cover web, and the second hook and loop fastener strips are spaced apart the predetermined spacing for securement to the first hook and loop fastener strips of each respective body opening to meter air flow through each respective body opening.

2. A hair dryer hood conduit as set forth in claim 1, including at least one body pocket mounted to an exterior surface of the cylindrical body between adjacent body openings, the body pocket defined by a predetermined height and including an upper entrance opening positioned exteriorly of the cylindrical body, and a lower opening at a lower distal end of the body pocket directed through the cylindrical body into communication interiorly of the cylindrical body, and a thermometer, the thermometer having a thermometer head and thermometer transmitter rod, the transmitter rod of a predetermined length equal to the predetermined height for reception within the body pocket.

* * * * *